US011083284B1

(12) United States Patent
Koga

(10) Patent No.: US 11,083,284 B1
(45) Date of Patent: Aug. 10, 2021

(54) DOUBLE TOP-PLATE DESK

(71) Applicant: RE-LEAF Inc., Tokyo (JP)

(72) Inventor: Takeshi Koga, Tokyo (JP)

(73) Assignee: RE-LEAF Inc., Tokyo (JP)

( * ) Notice: Subject to any disclaimer, the term of this patent is extended or adjusted under 35 U.S.C. 154(b) by 0 days.

(21) Appl. No.: 16/830,046

(22) Filed: Mar. 25, 2020

(51) Int. Cl.

| | |
|---|---|
| ***A47B 13/08*** | (2006.01) |
| ***A47B 1/10*** | (2006.01) |
| ***A47B 13/12*** | (2006.01) |
| ***A47B 17/03*** | (2006.01) |
| ***A47B 21/03*** | (2006.01) |

(52) U.S. Cl.
CPC ..... *A47B 13/081* (2013.01); *A47B 1/10* (2013.01); *A47B 13/12* (2013.01); *A47B 17/03* (2013.01); *A47B 21/03* (2013.01)

(58) Field of Classification Search
CPC ..... A47B 13/081; A47B 13/12; A47B 1/10; A47B 17/03; A47B 17/033; A47B 17/036; A47B 21/03
See application file for complete search history.

(56) References Cited

U.S. PATENT DOCUMENTS

| | | | | |
|---|---|---|---|---|
| 2,037,919 | A * | 4/1936 | Poe | A47B 17/06 108/93 |
| 8,561,602 | B2 * | 10/2013 | Andors | A47B 37/04 126/512 |
| 10,045,611 | B1 * | 8/2018 | Siebert | A47B 21/03 |
| 10,107,502 | B2 * | 10/2018 | Mueller | A47B 13/081 |
| 2002/0078865 | A1 * | 6/2002 | Kuvshinikov | A47B 46/00 108/143 |
| 2017/0049225 | A1 * | 2/2017 | Chau | A47B 37/00 |
| 2017/0156489 | A1 * | 6/2017 | Tippmann | A47B 17/04 |

* cited by examiner

*Primary Examiner* — Daniel J Rohrhoff
(74) *Attorney, Agent, or Firm* — PatentTM.US

(57) ABSTRACT

A double top-plate desk comprises a lower or first top plate 10, leg parts 40 for supporting the first top plate 10, and an upper or second top plate 20 which is substantially the same in size and shape as the first top plate 10, disposed above and substantially in parallel with the first top plate 10, slidably toward the rear (R) of the desk. The top plate 20 is slidable relative to the first top plate 10, from a state in which the two top plates are laid to overlap one above the other, toward the rear of the desk. To this end, a slide mechanism 30 is provided between the upper surface of the first top plate 10 and the lower surface of the second top plate 20 while supporting the second top plate 20 slidably toward the rear of the desk above the first top plate 10.

4 Claims, 9 Drawing Sheets

DOUBLE TOP-PLATE DESK

BACKGROUND OF THE INVENTION

Technical Field

The present invention relates to a double top-plate desk which includes a first top plate and a second top plate.

Background Art

Conventionally, a personal computer desk is known for work with a personal computer (PC), a display, a keyboard and other peripheral devices collectively mounted thereon, the desk including a main top plate and a sub top plate so that the sub top plate is provided for placing thereon the keyboard under the main top plate. The sub top plate is pulled out when it is used as necessary while, when not in use, being pushed in under the main top plate so that the sub top plate is housed thereunder.

Patent Document 1 raised below proposes a PC desk for operating a PC thereon, which is configured such that the PC desk is also usable for clerical work at the same time. An object of this PC desk is to allow a user to operate a PC or to do a clerical work without retracting the chair so that there is no need of a large-space office. To this end, the PC desk is configured such that it has a lower top plate for placing thereon a keyboard at a height lower than the ordinary desk top plate and an upper top plate slidably provided above the lower top plate for a clerical work, the upper top plate, in use for a keyboard operation, being retracted backward in the space under a display mounting table provided at the rear side, while, in clerical work, being pulled frontward over the keyboard.

Patent document 2 raised below proposes a desk with a slidable top plate, for dealing with a customer, which can be pulled out toward the side opposite to the owner seated at the desk. The slidable top plate can be used as an ordinary work desk when pushed in and stored under the desk top plate whereas it can be pulled out toward the side opposite to the owner seated at the desk when dealing with a customer.

Patent Document 1: JPA_2001-218635
Patent Document 2: JPU_1993-034925

SUMMARY OF THE INVENTION

In the PC desk of Patent Document 1 described above, the upper top plate has a limited area of a smaller space both in depth and width as compared to the lower top plate, resulting in not necessarily enough work space when pulled out frontward for clerical work. Also, the upper top plate is, when not in use, housed under the display table and it can be used to some extent for placing a document thereon. However, the storage of the upper top plate under the display table makes it difficult for a user not only to visually recognize the document as it is, but also to positively use the upper top plate as a work space. Further, even when nothing is placed on the upper top plate, what is placed on the lower top plate under the upper top plate is hidden by the upper top plate.

Therefore, the prior art technique shown in Patent Document 1 has a drawback that the upper and lower, two top plates are not always effectively utilized.

In the desk with the slidable top plate of Patent Document 2 described above, the slidable top plate is substantially the same in lateral width as and close in depth to the desk top plate, so that the pulled-out top plate makes it possible to greatly enlarge the area of the top plate of the whole desk. However, the slidable top plate is used to be drawn toward the side opposite to the seated owner when dealing with a customer, which is not for expanding the owner's work space. Although it is not impossible for the owner to use the pulled-cut slidable top plate as an expanded work space, the slidable top plate is housed under the desk top plate, and hence, each time when pulling it out the owner has to move around the desk to the rear to draw it out, which is not practical in use for expanding the owner's work space. In addition, there is only a gap, between the slidable top plate and the desk top plate, that avoids their contact to each other, resulting in no particular function or usage expected from the slidable top plate when it is housed under the desk top plate.

Therefore, the prior art technique shown in Patent Document 2 also has a drawback that the upper and lower, two top plates are not always effectively utilized.

The present invention was made under such circumstances and aims to provide a double top-plate desk which is capable of sufficiently securing areas for placing and storing objects while expanding a work area as needed.

The double top-plate desk according to the present invention comprises a first top plate, leg parts for supporting the first top plate, and a second top plate which is substantially the same in size and shape as the first top plate, disposed above and substantially in parallel with the first top plate, slidably toward the rear of the desk, at least a portion of the second top plate being formed of a see-through member.

The first and second top plates each is capable of placing an object thereon, the object placed on the first or lower top plate being visible through the second or upper top plate.

Simply by sliding the second or upper top plate backward as needed without the user himself or herself to move back, it is possible to expose at least a portion of the first top plate thereby expanding the work area.

Preferably, the first and second top plates are laid to overlap one above the other with a predetermined distance so as to make a space between the top plates. With this arrangement, the space between the first and second top plates serves as a storage space for objects.

The desk may comprise a slide mechanism that is provided between the upper surface of the first top plate and the lower surface of the second top plate, the slide mechanism slidably supporting the second top plate on the first top plate. The slide mechanism keeps a predetermined distance between the first and second top plate so as to provide a space therebetween, while supporting the second top plate slidably toward the rear of the desk above the first top plate along the shorter side direction of the first top plate. With this arrangement of such a slide mechanism between the upper surface of the first top plate and the lower surface of the second top plate, it is possible to securely supporting, with the slide mechanism, the first top plate which has a relatively heavy weight.

The leg part may have a caster part which movably supports the leg part. With this arrangement, in case where there is no space for sliding the second top plate backward, it is easily made to temporarily move the leg parts toward the front side of the desk.

In this specification, the term "desk" is referred to as an ordinary desk, but it is used in a broader sense to include a table.

According to the double top-plate desk of the present invention, it is possible not only to sufficiently secure an area for placing or storing objects but also to expand a work area as needed. In other words, various functions, such as placing objects on the desk, viewing objects on the desk, storing objects in the desk, working at the desk, are realized at the same time or in parallel, while allowing an expansion of the working area as needed, thus effectively utilizing the two top plates individually or cooperatively.

DESCRIPTION OF THE EMBODIMENTS

Hereinafter, an embodiment of the present invention will be described with reference to the accompanying drawings.

Figure 1:
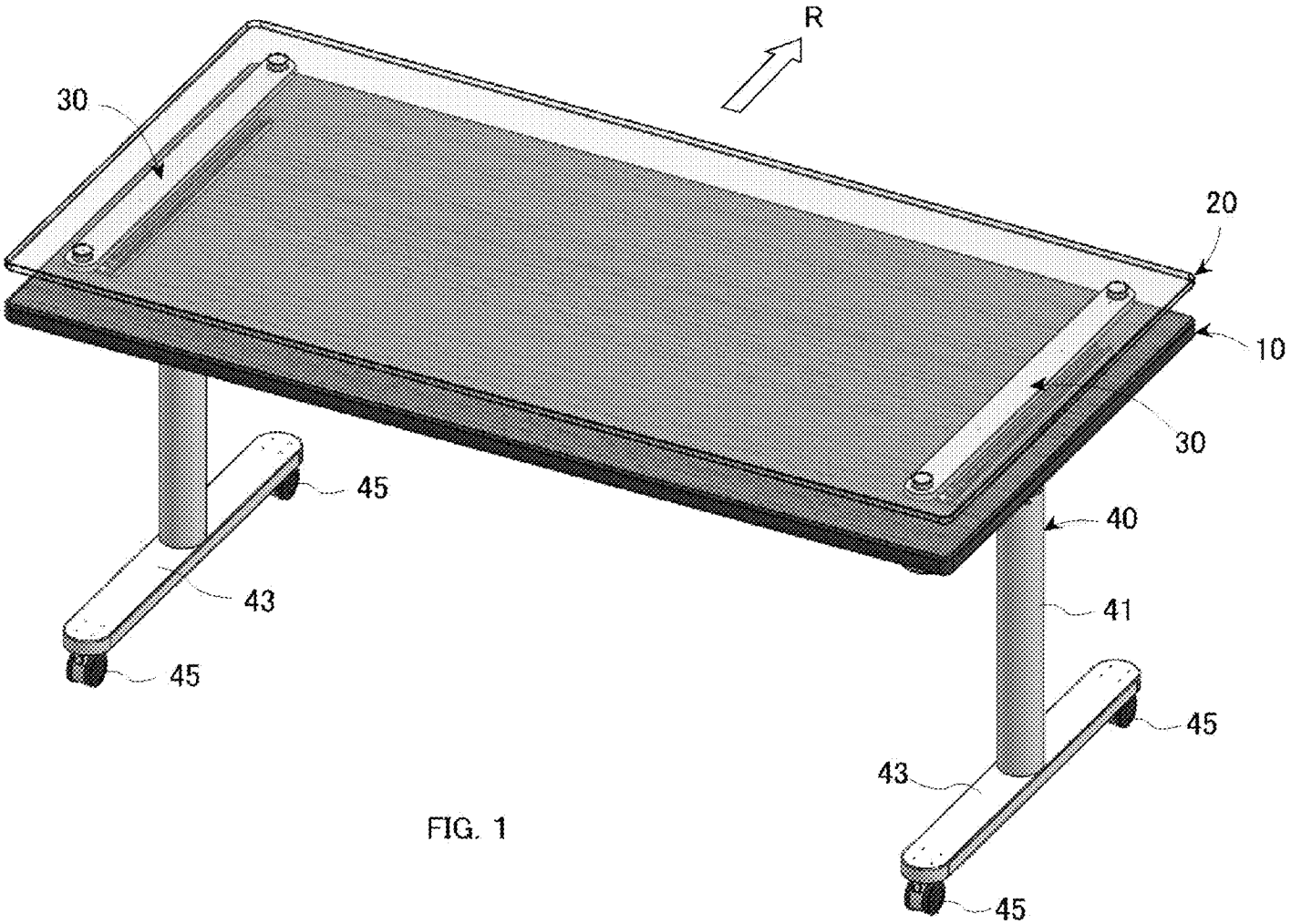
FIG. 1 shows a perspective view of the double top-plate desk according to an embodiment of the present invention.

FIG. 1 shows a perspective view of the double top-plate desk according to an embodiment of the present invention.

The double top-plate desk comprises a first top plate 10, leg parts 40 for supporting the first top plate, and a second top plate 20. The first top plate 10 has a substantially rectangular planar shape. Here, the "substantially rectangular" includes rectangle with rounded corners, oval and elliptical shapes, etc. The second top plate 20 is substantially the same in size and shape as the first top plate 10, disposed above and substantially in parallel with the first top plate 10.

Figure 2:
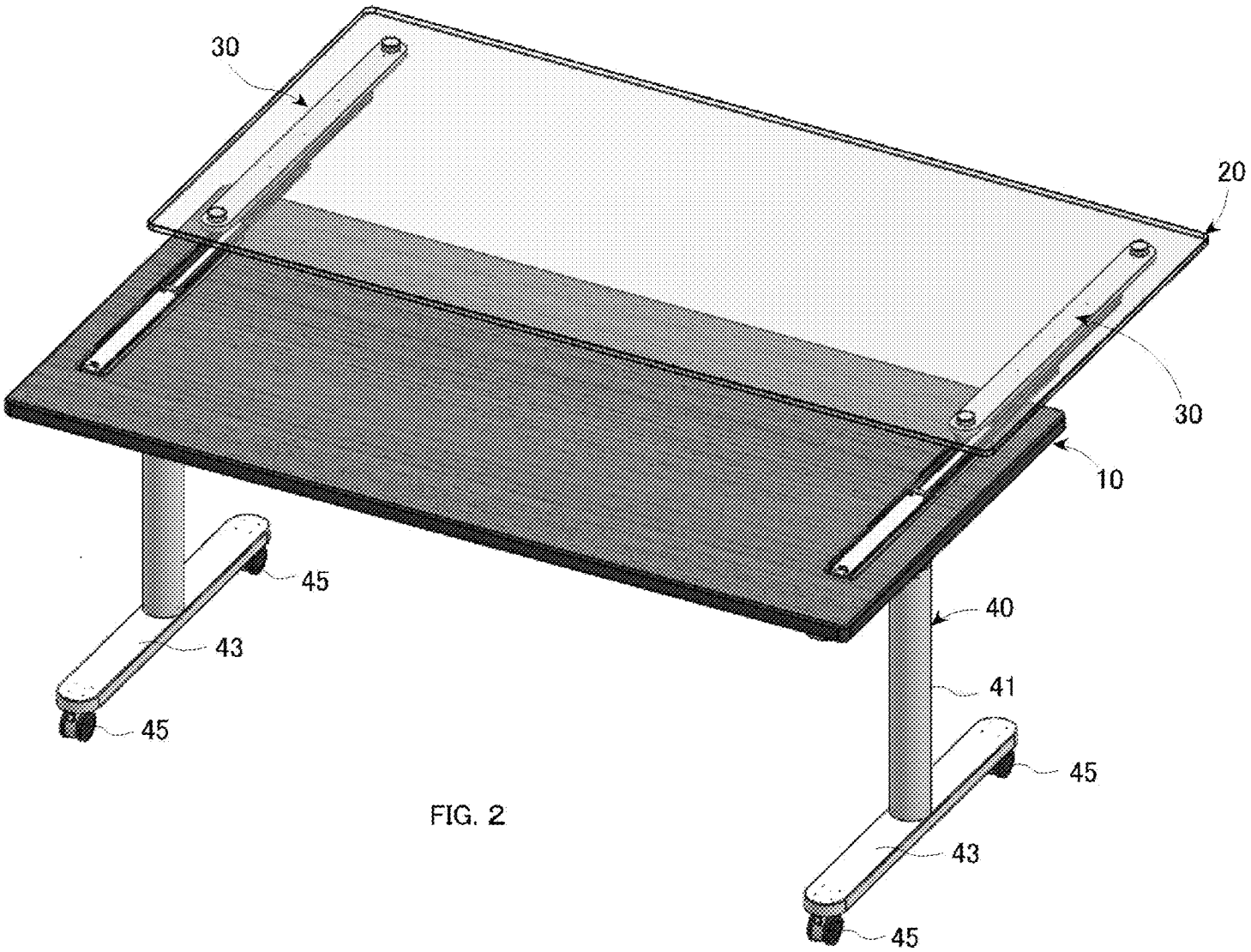
FIG. 2 is a perspective view showing a state in which the second top plate has been slid in the double top-plate desk according to the embodiment of the present invention.

FIG. 2 is a perspective view showing a state in which the second top plate 20 has been slid in the double top-plate desk according to the embodiment of the present invention. The double top-plate desk is configured so as to be able to slide the upper or second top plate 20 from a state as shown in FIG. 2, in which the two top plates are laid to overlap one above the other, relative to the lower or first top plate 10, toward the rear of the desk (in the direction as indicated by arrow R in FIG. 1). The phrase "toward the rear of the desk" normally means the direction to the side opposite to the side of the user seated at the desk.

To enable the second top plate 20 to slide relative to the first top plate 10, a slide mechanism 30 is provided between the upper surface of the first top plate 10 and the lower surface of the second top plate 20 while supporting the second top plate 20 slidably toward the rear of the desk above the first top plate 10.

In the present embodiment, the second top plate 20 is formed of a see-through or transparent member. Reinforced glass may be used as an example of such a material. However, the second top plate 20 does not necessarily have to be transparent over its entirety, but may be partially transparent.

The leg part 40 comprises a plurality of (here, two in this example) struts 41 which support the first top plate 10, and two foot plates 43 each extending along the front-rear direction. The two foot plates 43 support the bottoms of respective struts 41 at their center portions. Although not essential to the present invention, the foot plate 43 is provided with caster parts 45 at its front and rear ends for movably supporting the foot plates 43.

Figure 3:
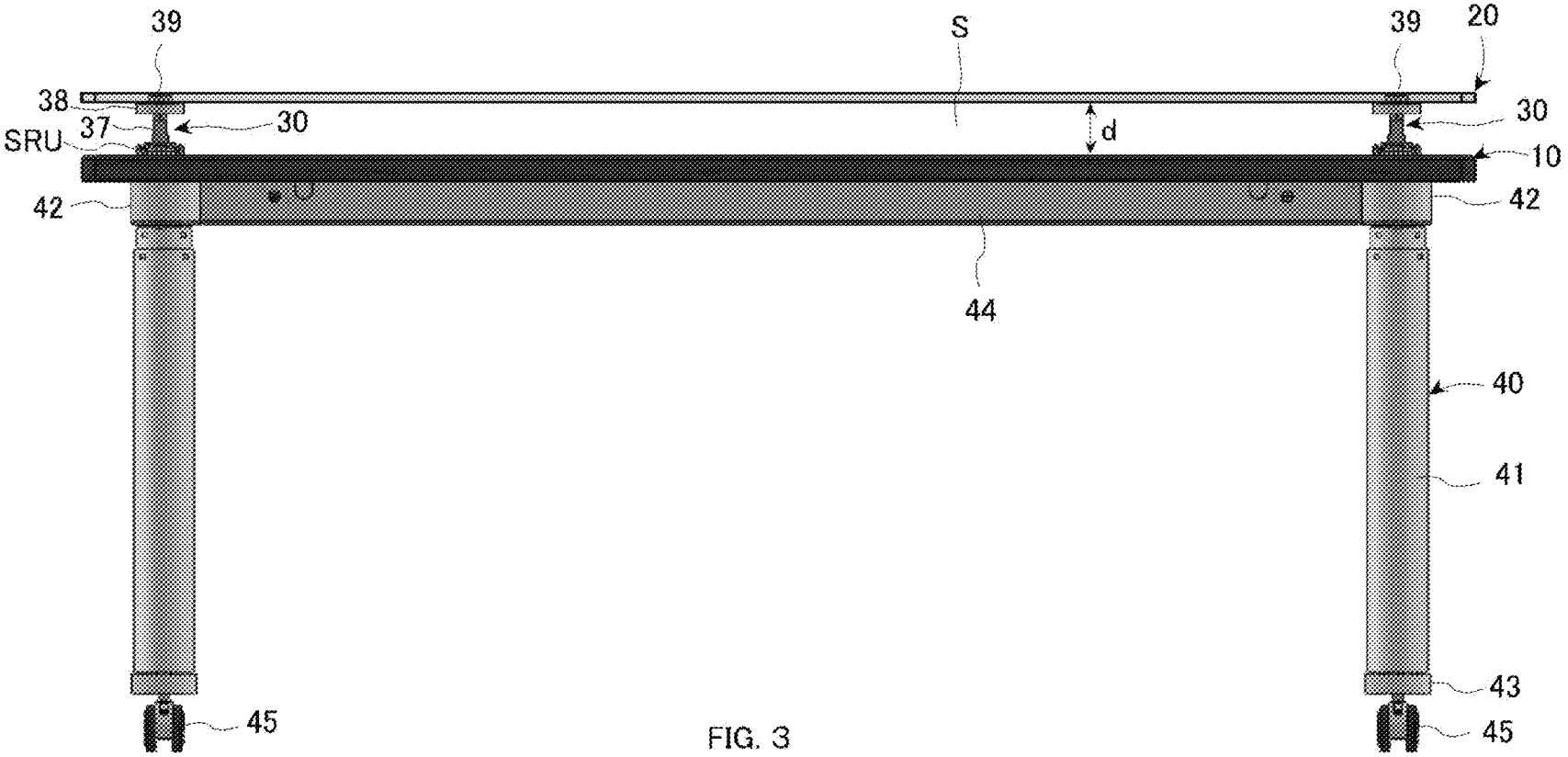
FIG. 3 is a front view of the double top-plate desk according to the embodiment of the present invention.
Figure 4:
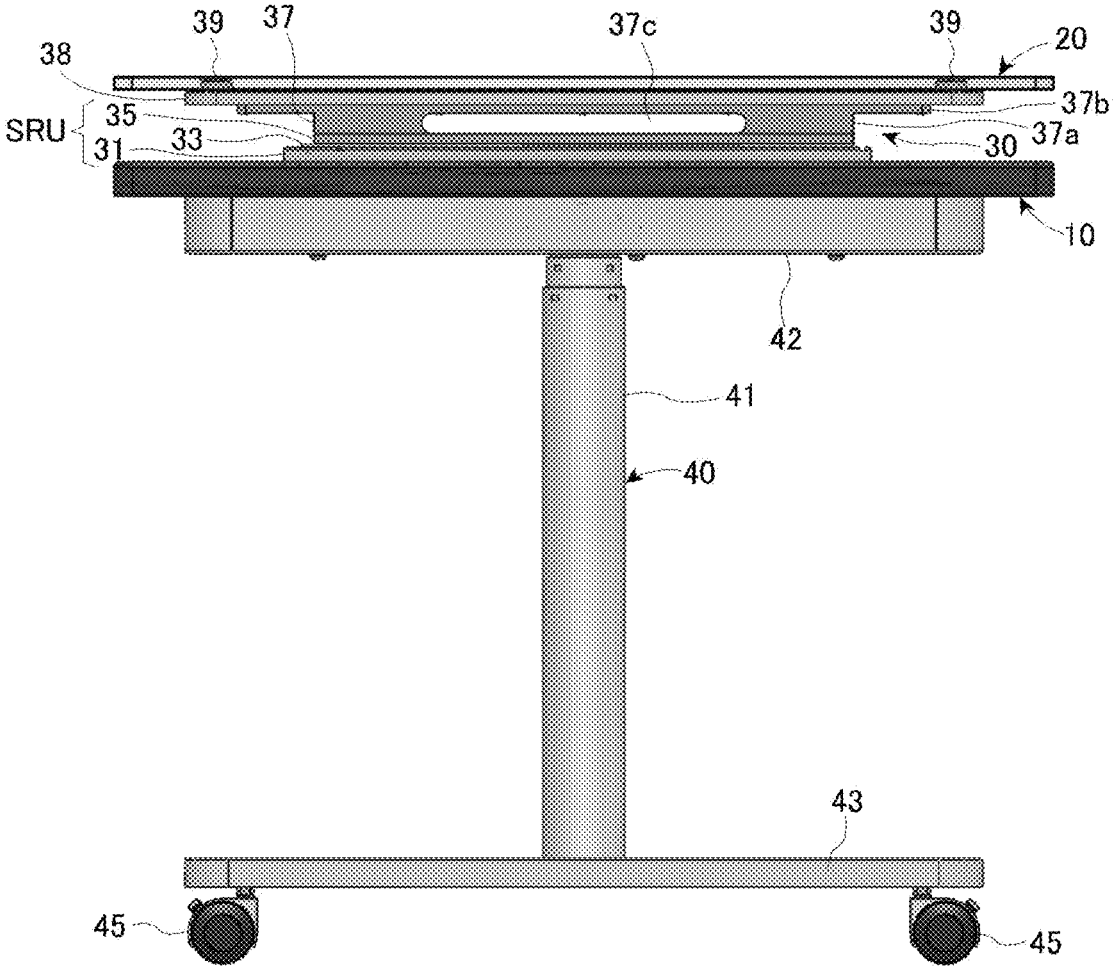
FIG. 4 is a right side view of the double top-plate desk in a contracted state according to the embodiment of the present invention.
Figure 5:
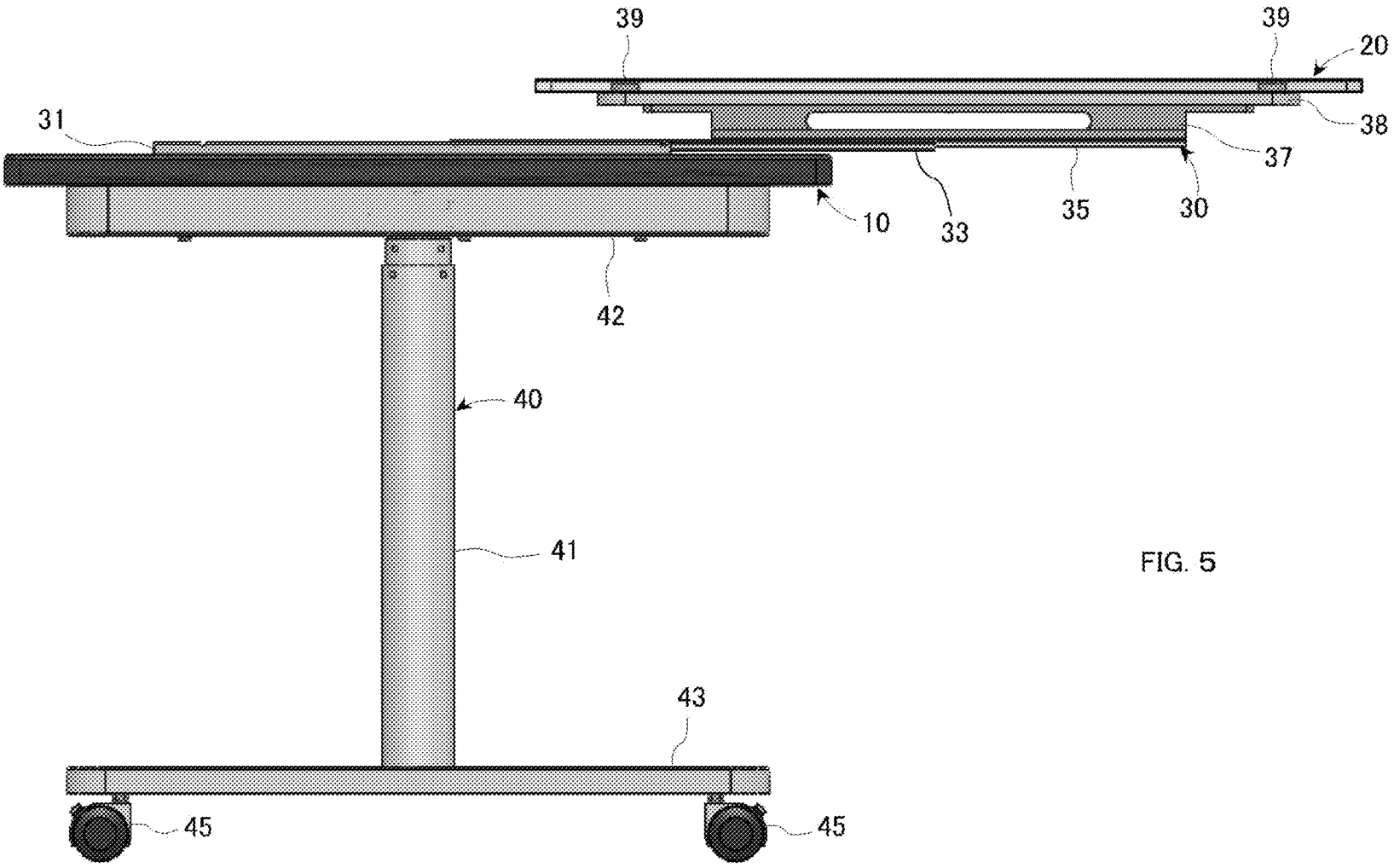
FIG. 5 is a right side view of the double top-plate desk in an extended state according to the embodiment of the present invention.

FIG. 3 is a front view of the double top-plate desk. FIGS. 4 and 5 are right side views of the double top-plate desk in a contracted state and in an extended state, respectively.

As can be seen from these Figures, the two struts 41 of the leg parts 40 support the two support girder parts 42 substantially at the center positions thereof in the vicinity of the left and right ends or both sides, of the top plate 10, the support girder parts 42 each extending along the front-rear direction. A support beam part 44 is provided which horizontally extends between the center portions of the two support girder parts 42.

The first and second top plates 10 and 20 have a predetermined distance d therebetween so as to create a storage space S (see FIG. 3) in a state in which they are laid to overlap one above the other. The predetermined distance d may not be limited in particular, and may vary depending on the application and function, but it could be for example about several millimeters to ten centimeters, and it is assumed to be five to six centimeters in the present embodiment.

Although it is not particularly limited how the storage space S between the two top plates is used, the storage space is suitable not simply for the storage use but, for example, for use in which objects to be stored such as a calendar, photos, reference materials are placed on the first top plate 10 which are seen through the second top plate 20 from above. The placing of the objects to be stored on the first top plate 10 does not interfere other objects or user's hand during desk work as compared to a case of placing them on the second top plate 20, and thus the stored objects do not hinder the work. It can be quickly and easily performed to add, remove or replace the stored objects without the user moving back (for example, retracting the seated chair), by sliding the second top plate 20 toward the rear of the desk, exposing the first top plate 10 from the user side.

The leg part 40 is provided with the caster parts 45, which allows the leg part 40 to be temporarily moved easily toward the front side of the desk in a case where there is no space for sliding the second top plate backward.

In addition, in a case where the second top plate 20 alone is insufficient in work area, the second top plate 20 can be slid toward the rear of the desk to thereby make it possible to use the exposed area of the top plate 10 as an additional work area.

Figure 6:
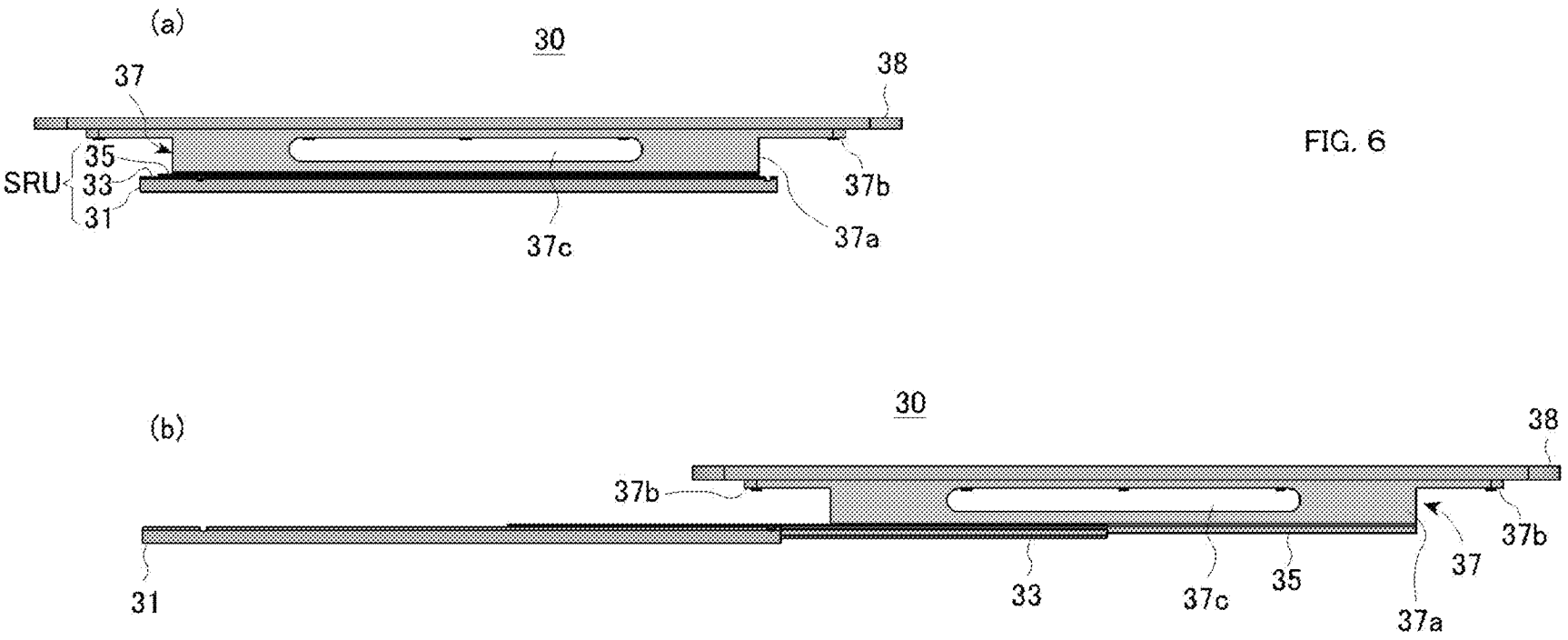
FIG. 6 shows side views of a slide mechanism in its contracted and extended states of the double top-plate desk according to the embodiment of the present invention.
Figure 7:
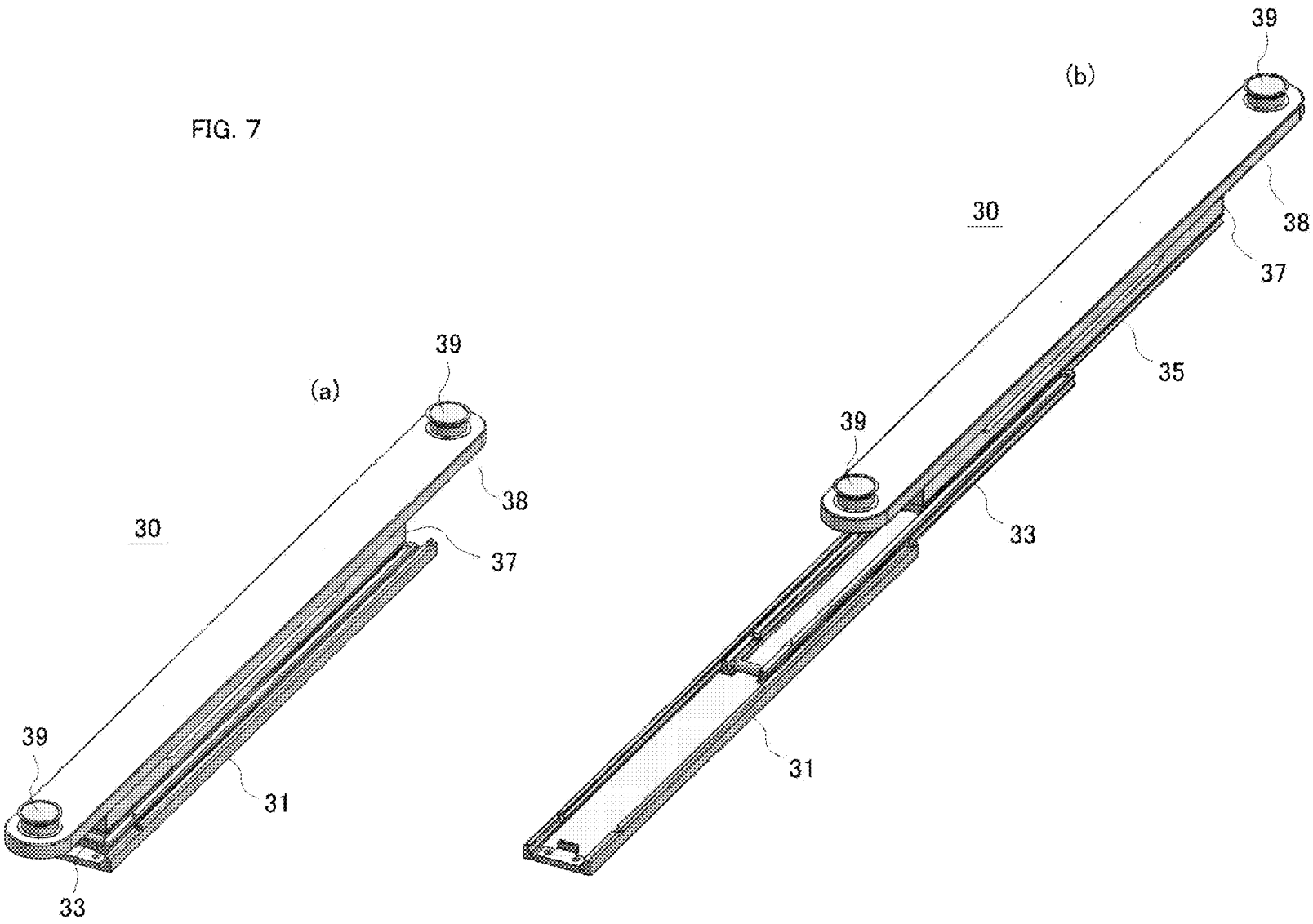
FIG. 7 shows perspective views of a slide mechanism in its contracted and extended states of the double top-plate desk according to the embodiment of the present invention.

FIGS. 6(*a*) and 6(*b*) show side views of a slide mechanism 30 in its contracted and extended states of the double top-plate desk, respectively, according to the embodiment of the present invention. FIGS. 7(*a*) and 7(*b*) show perspective views of the slide mechanism 30 in its contracted and extended states of the double top-plate desk, respectively, according to the embodiment of the present invention.

As best shown in FIG. 6(*a*), the slide mechanism 30 comprises a slide rail unit SRU, a spacer member 37 and a support plate part 38.

The slide rail unit SRU comprises an outer member 31, an intermediate member 33, and an inner member 35 which are three nested elongated members. The outer member 31 is an elongated member which is fixed on the surface of the first top plate 10. Although there is no particular limitation on the means for fixing, but, for example, prior art means such as screwing may be used. The intermediate member 33 is slidably supported on the outer member 31 along the longitudinal direction thereof. Further, the inner member 35 is slidably supported on the intermediate member 33 along the longitudinal direction thereof. A lubricating means such as ball bearings, not shown, may be provided between the elongated members which slide relative to each other.

Stopper members, the specific structures of which are not shown, are provided at predetermined positions of the intermediate member 33 so as to limit the movable range of the intermediate member 33 relative to the outer member 31 when the intermediate member 33 extends and retracts relative to the outer member 31. Similarly, stopper members are provided at predetermined positions of the inner member 35 so as to limit the movable range of the inner member 35 relative to the intermediate member 33 when the inner member 35 extends and retracts relative to the intermediate member 33.

With the slide rail mechanism of a so-called three-fold type, it is possible to expand the amount of slide of the inner member 35 relative to the outer member 31 while maintaining the load bearing characteristics, as compared to a two-fold type mechanism. However, the present invention is not limited to the three-fold type configuration. As such a typical configuration of the three-fold type slide rail unit SRU, for example, a slide rail CBL-D500 made of aluminum alloy is commercially available from SUGATSUNE KOGYO CO. LTD.

A spacer member 37 is fixed on the surface of the inner member 35. Means for fixing it is not limited. The spacer member 37 comprises an upright part 37*a* upstanding from the inner member 35, and a support plate part 38 horizontally extending from the upper side of the upright part 37*a*. The height of the storage space S between the top plates 10 and 20 is determined based on the height of the spacer member 37. An opening 37*c* is provided in the upright part 37*a* along the longitudinal direction thereof. The opening 37*c* serves to reduce the weight and material of the slide mechanism, but is not essential to the present invention.

As best shown in FIG. 4, the top plate 20 is fixed to the support plate part 38 so that the support plate part 38 supports the top plate 20. This fixing is performed by using a fixing unit 39 which fixes the top plate 20 to the support plate part 38. A specific example of the fixing unit 39 will be described later.

The support plate 37*b* does not directly support the top plate 20, but rather supports via the support plate part 38 which is wider and longer than the support plate 37*b*. This arrangement allows the top plate 20 made of reinforced glass to be mounted securely and easily onto the spacer member 37.

Figure 8:
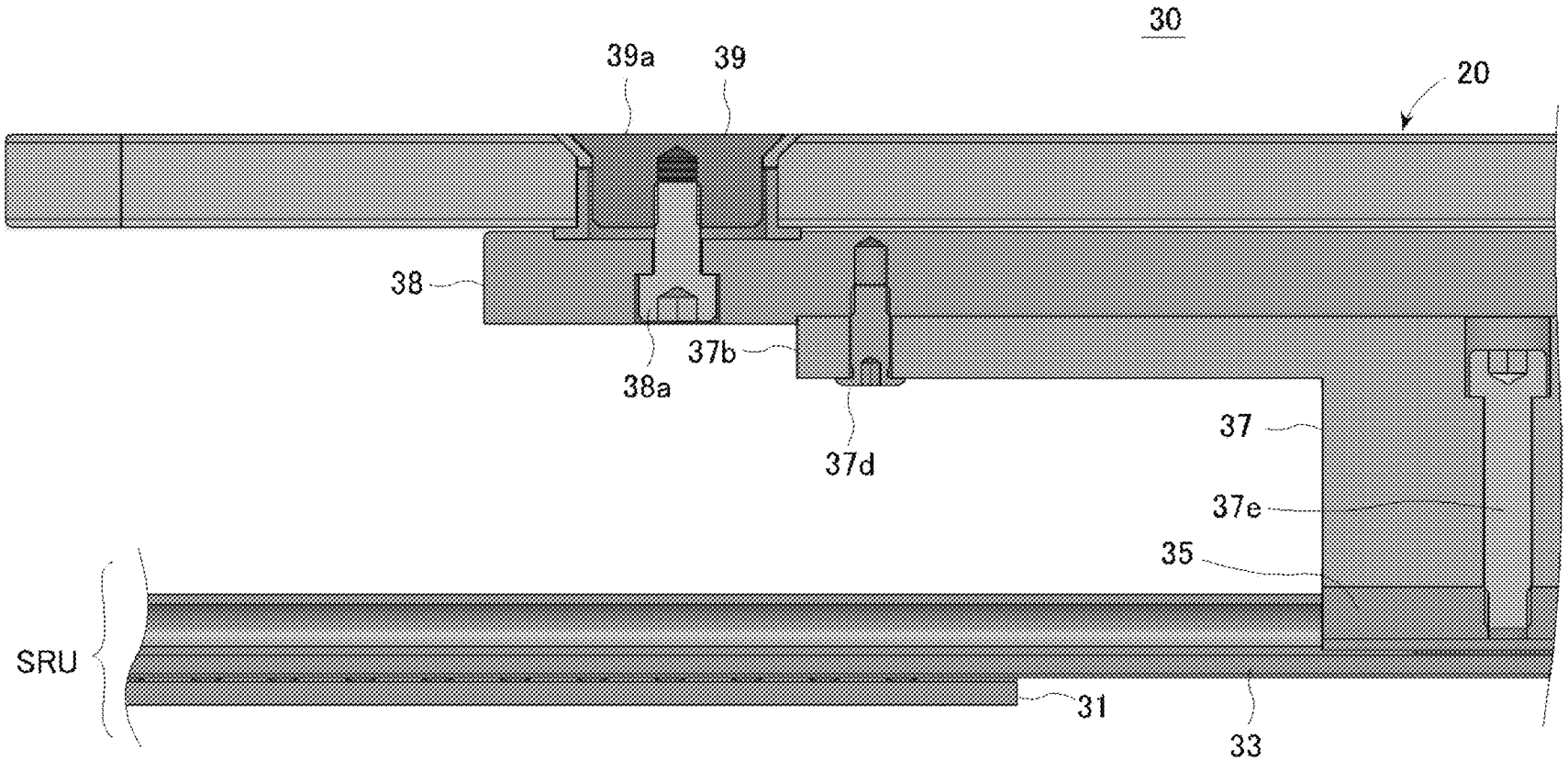
FIG. 8 is a section view showing a specific example of means for mutually connecting parts of the double top-plate desk according to the embodiment of the present invention.

Referring to FIG. 8, a description will be given of a specific example of means for mutually connecting the top plate 20, the support plate part 38, the spacer member 37 and the SRU.

As described above, the top plate 20 is fixed onto the support plate part 38 with the fixing unit 39. In this example, the fixing unit 39 is to insert a bolt 38*a* from under the support plate part 38 into a bracket-like nut 39*a* which is fitted in the top plate 20 at the predetermined position for fastening and fixing. The nut 39*a* has a disk-like head and is set such that its surface is aligned with the surface of the top plate 20. To this end, the surface of the top plate 20 at the positions where the nuts 39*a* are set is cut in a mortar shape.

The connection of the support plate part. 38 to the spacer member 37 is realized with bolts 37*d* screwing from the side of the support plate 37*b* of the spacer member 37 to the support plate part 38 at predetermined positions.

The connection of the spacer member 37 to the SRU is realized with bolts 37*e* screwing from the side of the spacer member 37 to the inner member 35 of the SRU at predetermined positions.

According to the double top-plate desk of the present embodiment described above, the following functions and advantages are provided.

(1) It is possible to put an object on each of the double top plates. That is, the area for placing objects is expanded as compared to the conventional desk with a single top plate.

(2) The employing of a see-through member as the second top plate allows not only visually recognizing what is placed on the second top plate but also visually recognizing what is placed on the first top plate through the second top plate. Such "what is placed on the first top plate" is not limited to any particular object as far as it is capable of being stored. For example, closed or opened books, magazines, printed matters, peripheral devices such as a keyboard and a mouse, an electronic device such as a tablet or a smartphone with a display screen can be visually recognized or its operating states (power light, display images, etc.) can be checked through the second top plate. This means that the visually usable space on the desk is expanded.

(3) The placing of an object on the lower, first top plate is equivalent to the storing of it in the storage space. The object stored can be seen through the second top plate. It is possible to place, on the first top plate, an object that, for the time being, need not be viewed, or needs to be viewed but not to be taken in hand.

(4) Not only the upper surface of the second top plate is usable for a work area but also the upper surface of at least a portion of the first top plate is usable for another work area by sliding the second top plate toward the rear of the desk. That is, the overall work space can be increased. For example, it is possible to place a computer display device on the upper or second top plate while placing peripheral devices such as a keyboard, a mouse, a touch pad, etc. on the lower or first top plate. With this arrangement, the peripheral devices can be housed under the second top plate when they are not in use, while the second top plate can be slid toward the rear of the desk when the peripherals are not in use so that they are exposed so as to be operated. The second top plate serves as a cover for the peripheral devices when they are stored, so that it is possible to reduce the possibility that dust is accumulated on the peripheral devices and to prevent them from stained by a beverage such as coffee. The slide operation of the second top plate can be performed, without using any operation handle or the like, just by user's simple and intuitive manual operation of pushing or pulling the top plate back and forth.

In addition, in doing so, there is no need for the user himself or herself to retract (e.g. retract the seated chair). As a result, there is no hindrance to the sliding operation of the top plate even if there is an obstacle such as a wall, a cabinet, a sill, etc. just behind the user.

(5) When a display device is placed on the second top plate, it is possible to adjust the distance from the user (or user's point of view) to the screen by sliding the second top plate back and forth without changing the position of the user (chair).

According to the double top-plate desk of the present embodiment, such various functions are realized simultaneously or in parallel which allows effectively utilizing the two top plates 10 and 20 in total.

While the preferred embodiment of the present invention has been described above, various modifications and changes can be made in addition to those mentioned above.

For example, in addition to the first and second top plates, a third top plate may be provided. In that case, it is preferable that two upper top plates are made of see-thorough members. The distance between the first and second top plates may be different from that between the second and third top plates.

Although the number of the struts 41 of the leg part 40 is set to two, it is not limited thereto. For example, the number may be four. The configurations and the numbers of the support girder parts 42 and the support beam part 44 are not limited to those shown in the drawing.

The caster parts 45 of the leg part 40 may be omitted.

Figure 5A:
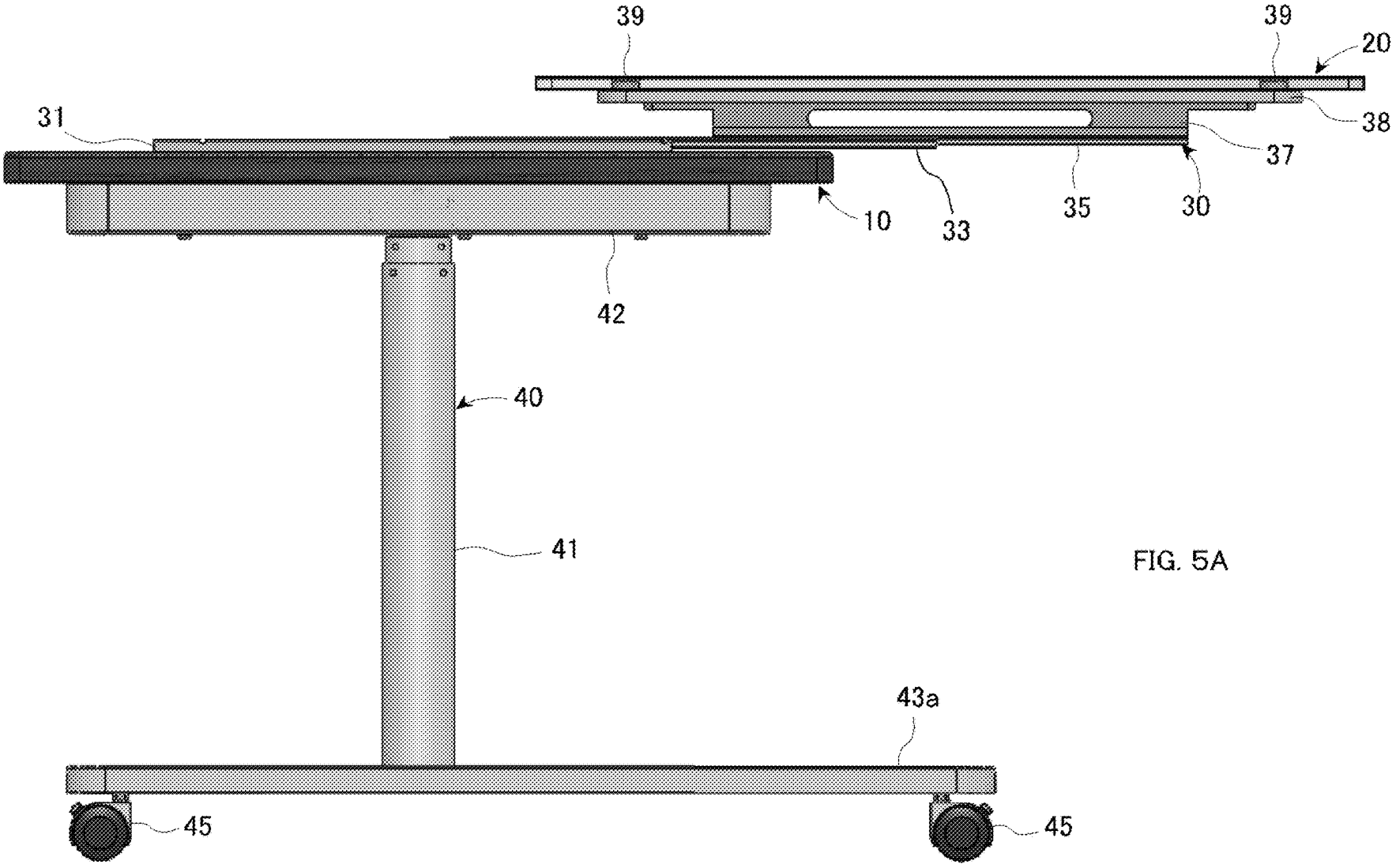
FIG. 5A is a right side view of the double top-plate desk of FIG. 5, with longer foot plates.

In some cases, when the upper or second top plate is slid toward the rear side of the desk, stability of the posture of the entire desk could be lowered. Particularly, when a heavy object is placed at a rear position of the second top plate, a force or moment could occur to cause the desk to turn over backward. In order to cancel or reduce such forces, means may be provided for preventing the entire desk from lowering the stability of its posture when the second top plate is slid toward the rear of the desk. Such means may be realized by changing the material, shape, size, etc. of the whole or part of a particular member, such as the leg part 40, or providing additional member such as a heavy load or supporting member, at a predetermined location. For example, the foot plates 43 may be made longer in the backward direction as compared to the support girder parts 42, as shown by foot plate 43*a* in FIG. 5A, and/or the foot plates 43 may be made heavier.

What is claimed is:

1. A double top-plate desk, comprising:

a first top plate;

leg parts for supporting the first top plate; and a second top plate which is substantially the same in size and shape as the first top plate, disposed above and substantially in parallel with the first top plate, slidably toward the rear of the desk, at least a portion of the second top plate being formed of a see-through member, the first and second top plates being laid to overlap one above the other, at a predetermined distance so as to make a space between the top plates, a slide mechanism that is provided between the upper surface of the first top plate and the lower surface of the second top plate, the slide mechanism slidably supporting the second top plate on the first top plate, wherein the first top plate has a substantially rectangular planar shape, and wherein the slide mechanism supports the second top plate slidably toward the rear of the desk above the first top plate along the shorter side direction of the first top plate, and wherein the slide mechanism comprises at least first and second elongated members overlapped and slidable with each other, and a spacer fixed on the upper elongated member for keeping the predetermined distance.

2. The double top-plate desk according claim 1, wherein the leg part includes a caster part which movably supports the leg part.

3. The double top-plate desk according claim 1, further comprising means for preventing the entire desk from lowering the stability of its posture when the second top plate is slid toward the rear of the desk.

4. The double top-plate desk according claim 1, wherein the second top plate is made of reinforced glass.

* * * * *